US005311703A

United States Patent [19]

Ketteringham

[11] Patent Number: 5,311,703

[45] Date of Patent: May 17, 1994

[54] MULTIPLE PURPOSE TOOL GRINDING DEVICE

[75] Inventor: Thomas Ketteringham, Mevagissey, England

[73] Assignee: Martek Limited, Cornwall, England

[21] Appl. No.: 743,870

[22] Filed: Aug. 12, 1991

[30] Foreign Application Priority Data

Aug. 11, 1990 [GB] United Kingdom ..... 9017825

[51] Int. Cl.[5] ..... B24B 3/26; B24B 3/52; B24B 3/54

[52] U.S. Cl. ..... 51/3; 51/122; 51/103 R; 51/231; 51/268

[58] Field of Search ..... 51/72 R, 74 R, 91 R, 51/92 R, 74 BS, 91 BS, 92 BS, 109 BS, 110, 121, 122, 95 LH, 94 CS, 219 R, 219 PC, 288, 285, 241 G, 238 R, 240 R, 240 A, 240 GB, 268, 238 S, 271, 216 ND, 218 A, 218 R, 109 R, 230, 231, 216 A, 3, 103 R; 269/290, 291

[56] References Cited

U.S. PATENT DOCUMENTS 3,808,748 5/1944 Gunnerson ..... 51/219 R
3,879,899 4/1975 Ribar ..... 51/231
3,905,157 9/1975 Sollami ..... 51/219 R
4,065,886 1/1978 Harwood et al. ..... 51/268
4,259,814 4/1981 Glaser et al. ..... 51/122
4,742,648 5/1988 Ketteringham ..... 51/98.5
4,961,288 10/1990 Ketteringham ..... 51/218 R
4,996,797 3/1991 Laughton ..... 51/238 R

*Primary Examiner*—Bruce M. Kisliuk
*Assistant Examiner*—Bryan Reichenbach
*Attorney, Agent, or Firm*—Gifford, Groh, Sprinkle, Patmore and Anderson

[57] ABSTRACT

A tool sharpening device (11) has a rotary grindstone (14), a tool support (34) and linear guides (32, 33) along which the tool support (34) is displaceable in use of the device. The linear guides (32, 33) extend transversely of the axis of rotation of the rotary grindstone (14) and their location is such as to guide a tool carried by the tool support (34) so as to transit across the end face (15) of the rotary grindstone (14). The tool support (34) is releasably connected to the linear guides in such a way that the tool support (34) can be positioned on the linear guides (32, 33) with a tool support face (35) lying at one of two different inclinations to the plane defined by the end face (15) of the grindstone (14).

9 Claims, 4 Drawing Sheets

MULTIPLE PURPOSE TOOL GRINDING DEVICE

The present invention relates generally to a tool sharpening device, and particularly to a sharpening device having a rotary grindstone and means by which a plurality of different tools, both those having sharp edges and those having shaped edges, may be ground.

A number of different edge tools may be used in a single workshop or domestic environment. For example, a workshop may be provided with chisels, gouges, twist drills, cutting knives, shears and other tools, such as screwdrivers which, although they do not have sharp edges, nevertheless need to be kept in condition with their blades clean and square and not rounded with use. Until now it has been necessary to seek to sharpen such tools either on a general purpose grindstone in an ad hoc manner, which is unsatisfactory and highly dependent on the skill of the operator, or by using individual special purpose tools, which compensate for the lack of skill of the operator, but correspondingly have the disadvantage that a single special purpose tool is required to sharpen any particular kind of edge tool so that a workshop may become cluttered with a number of different pieces of equipment the function of which is generally supportive rather than operational.

The present invention seeks to provide a tool grinding device which, while fulfilling the function of a general purpose grinder in that it is capable of being used for a wide range of different grinding purposes, also offers the advantages of special purpose tool-sharpening equipment, in that it is provided with guides and other means by which different tools can be held in appropriate orientations and positioned for sharpening or grinding without requiring a high degree of skill from the operator.

According to one aspect of the present invention, there is provided a tool sharpening device having a rotary grindstone, a tool support and linear guide means along which the tool support is displaceable in use of the device, the linear guide means extending transversely of the axis of rotation of the rotary grindstone, characterized in that the location of the linear guide means is such as to guide a tool carried by the tool support to transit across the end face of the rotary grindstone, and in that the tool support is releasably connected to the linear guide means whereby to allow the tool support to be positioned selectively on the linear guide means with a tool support face thereof at one of two different inclinations to the plane defined by the end face of the grindstone.

In a preferred embodiment of the invention the rotary grindstone is carried in a housing having at least one fixed reference surface in contact with which a tool to be sharpened can be guided in grinding engagement with the rotary grindstone.

To fulfill its function as a multiple purpose tool sharpening device to best effect there are preferably provided two such reference surfaces the form of which will be described in more detail below. In use of the device of the present invention, then, any specific edge tool to be sharpened, may be engaged against an appropriate guide surface so as to be held in an optimum orientation to be presented to the grindstone to have a grinding operation performed thereon for sharpening purposes.

In another aspect the present invention provides a tool sharpening device having at least one grindstone with a plurality of fixed inclined guide surfaces at different angles to one another whereby to provide guidance for different tools to be sharpened thereby.

Thus, shears, knives, scissors, chisels etc can all be sharpened, and screwdrivers ground, using the same sharpening device, by appropriate selection of the guide surface or other guide means against which the tool may be engaged in order to hold it in an appropriate orientation.

According to another aspect of the present invention a tool sharpening device having a rotary grindstone, a tool support, and linear guide means for the tool support, may be provided with means for supporting a guide body, the guide body having means for engaging it in different positions on the linear guide means whereby to offer different angles of grinding to sharpen edge tools at a different angle utilizing the same tool support or reference surface.

In this aspect the present invention provides a guide body having at least one reference surface against which an edge tool to be sharpened may be engaged to be presented to the grindstone, and the inclination of this reference surface to the contact surface of the grindstone may be adjusted by appropriate positioning of the guide body on the linear guide means. Having been positioned on the linear guide means the guide body can be displaced therealong to cause the edge tool in engagement with the reference surface to transit past an appropriate part of the grindstone surface in contact therewith.

In one embodiment of the invention the linear guide means comprise two rectilinear guide rails and the tool support is releasably engageable on the guide rails in one of two positions with the tool support surface of the tool support respectively inclined at a first and a second angle to the plane defined by the end face of the grindstone.

The guide body preferably has a second reference surface inclined with respect to the first reference surface referred to above, which can be brought into a position for engagement with an edge tool to be sharpened upon a change in orientation of the guide body from the first and second orientation in which the first reference surface is in its engagement position to a third orientation in which the second reference surface is in its engagement position. Preferably the guide body is provided with releasable guide engagement means and is slidable along fixed guides in the first orientation, in which the first reference surface is in the position of use, and is provided with fixed engagement means locating the guide body in a fixed position along the linear guide to prevent sliding therealong in the third orientation.

Embodiments of the invention may also be provided with a second grindstone turnable about a respective axis of rotation. This may be driven via a drive train from the same input shaft as the rotary grindstone. Alternatively, of course, the second grindstone may be independently driven. In the specific embodiment to be described hereinbelow, however, the second shaft is driven via a drive coupling from the shaft carrying the grindstone. The drive coupling may incorporate a bevel gear connecting a second shaft lying at an angle to the first so as to be driven by a common drive device.

Preferably the tool support surface of the tool support has an upstanding shoulder defining one lateral edge of the surface, against which shoulder a tool is engageable in use of the device whereby to locate it securely on the tool support, the tool support surface defining a first tool support plane, and a secondary support surface portion at one end of the tool support surface, lying at an angle thereto, the upstanding shoulder terminating at the secondary support surface portion whereby to allow a tool engaged thereon to project on either side thereof. The upstanding shoulder may have an inclined end portion at the end thereof nearer the secondary support surface portion, the inclined end portion being substantially co-planar with the secondary support surface portion.

In a preferred embodiment of the invention an input end of the input shaft projects beyond a casing of the device for attachment to a power drill or other source of motive power.

The second shaft may carry a rotatable grindstone having a cylindrically curved surface, and the body or casing of the device may have guide surfaces formed thereon, or on a member carried thereby, for cooperation with a twist drill holder having means for retaining a twist drill to be sharpened, the cooperation being such that the drill is held against relative movement with respect to the holder both parallel to the axis of the drill and around the axis of the drill, the drill holder having locating surfaces for cooperative engagement with the guide surfaces on the body or casing such that when these surfaces are in engagement with one another a twist drill held in the holder lies in a plane inclined at a predetermined angle with respect to a plane perpendicular to the axis of the cylindrical surface of the grindstone with the line of contact between the drill tip and the cylindrical surface of the grindstone extending generally parallel to the axis of the cylindrical surface and offset from a diametral plane of the grindstone parallel to the axis of the drill, such that axial advance of the drill towards the grindstone is determined by the cooperating surfaces of the body or casing and the holder in dependence on the relative angular orientation of the drill about its axis with respect to the casing or body of the device.

This part of the device is suitable for sharpening twist drills of any type, that is both HSS twist drills and masonry drills. For this purpose the device preferably also includes means for setting the drill both angularly and to a determined depth in relation to the twist drill holder so that the locating surfaces on the twist drill holder and the guide surfaces on the casing or body of the device are in correct relative orientation to the cutting edges at the tip of the drill. In order to achieve this the device of the present invention preferably includes drill setting means which may be formed in or on the casing or in association thereto, by which the depth of projection and orientation of a twist drill within a range of sizes which can be accepted by the device for sharpening can be determined. Since the device must be capable of operating effectively and accurately on a range of different sizes it is preferred that the twist drill setting means comprise means for engaging the locating surfaces on the drill holder and a pair of opposed elements which are mounted for rectilinear movement toward or away from each other whereby to engage the web of a twist drill at or adjacent the tip thereof from opposite sides whereby to determine the angular orientation of the drill. Such movement towards or away from one another may be achieved by the use of a suitable interconnection which maintains a fixed relation between the two rectilinearly displaceable elements and a notional central position between them. In other words, with respect to the casing of the device as a fixed frame of reference, both rectilinearly displaceable elements are movable towards and away from a center line at which point they contact one another. It is possible, especially for twist drills of relatively larger diameter, to arrange for the rectilinearly displaceable elements to be mounted such that only one of them is displaceable with respect to the casing, so that the center line of the twist drill being set thereby is different depending on the diameter of the twist drill.

One embodiment of the present invention will now be more particularly described, by way of example, with reference to the accompanying drawings, in which.

Figure 1:
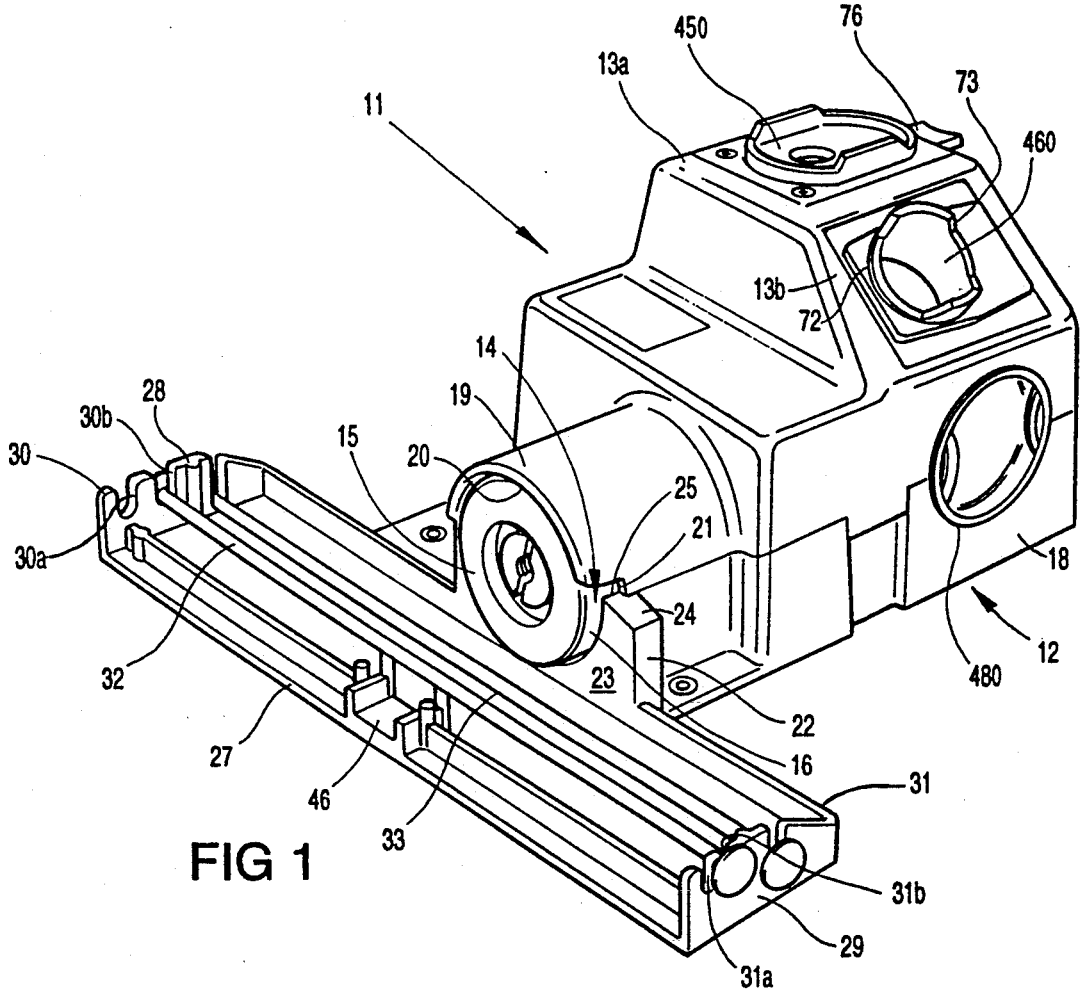
FIG. 1 is a perspective view of the device of the present invention.

Referring now to the drawings, the multiple purpose sharpening tool 11 of the present invention is housed within a casing generally indicated 12 having an upper face at one end comprising a horizontal portion 13*a* and an inclined portion 13*b*.

Figure 4:
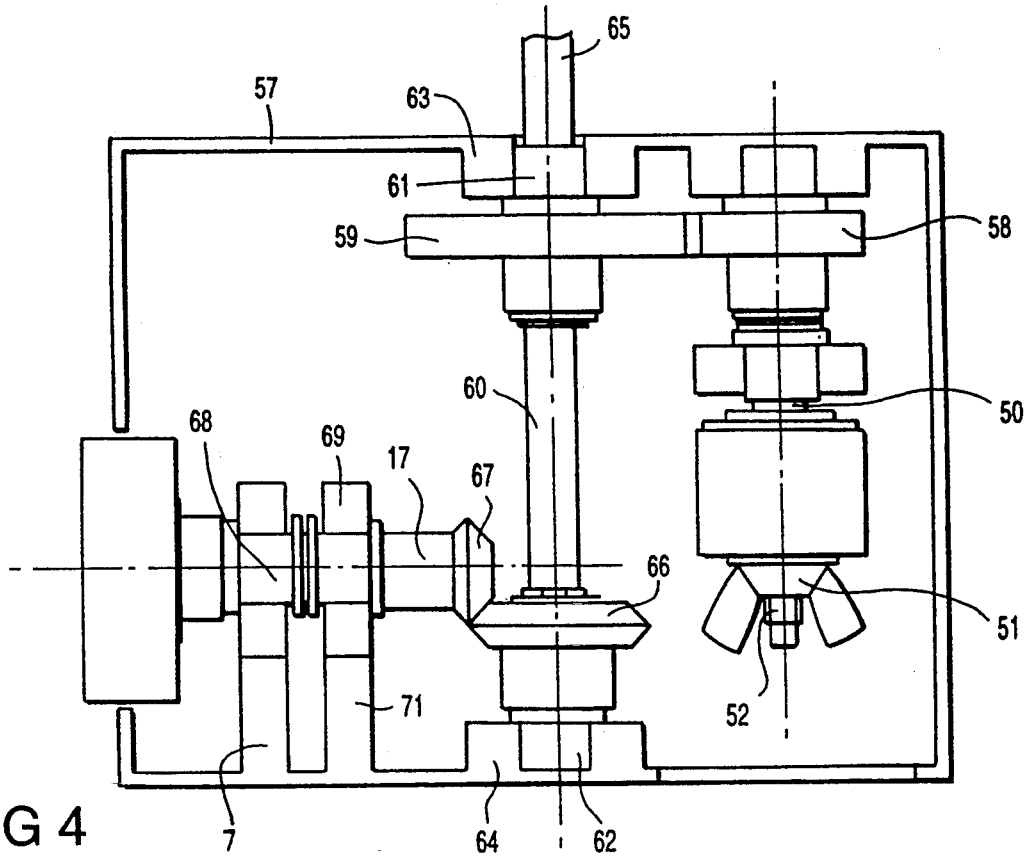
FIG. 4 is a sectioned view from above of the embodiment.

A cylindrical grindstone 14 having an annular end face 15 and a cylindrical surface 16 is carried on a spindle 17 (FIG. 4) extending parallel to and behind a front face 18 of the casing 12. The grindstone 14 is located within a part-cylindrical guard 19 having an end face 20. The guard 19 has a small cut-away opening 21 through which the cylindrical surface 16 of the grindstone 14 is exposed.

Forwardly of the opening 21 extends a support post 22 having a side face 23 and an upper reference surface 24 which is inclined at a shallow angle to a diametral plane of the grindstone 14 passing through an adjacent edge 25 of the reference surface 24. The reference surface 24 is usable for supporting small tools such as screwdrivers or center punches which do not require to be ground to a cutting edge.

Running transversely of the axis of the spindle 17 the casing 12 has a rectilinear guide frame 27 having two end walls 28, 29 having upper faces 30, 31 respectively in which are located two upwardly open generally U-shape notches or recesses 30*a*, 30*b* and 31*a*, 31*b* respectively. An elongate guide rod 32 can be fitted into the pair of notches or recesses 30*b*, 31*b* or into the pair of notches or recesses 30*a*, 31*a*. A second guide rod 33 is located in a fixed position, also in respective notches, extending parallel to the guide rod 32 and supported on the two end walls 28, 29 of the guide frame 27.

Figure 2:
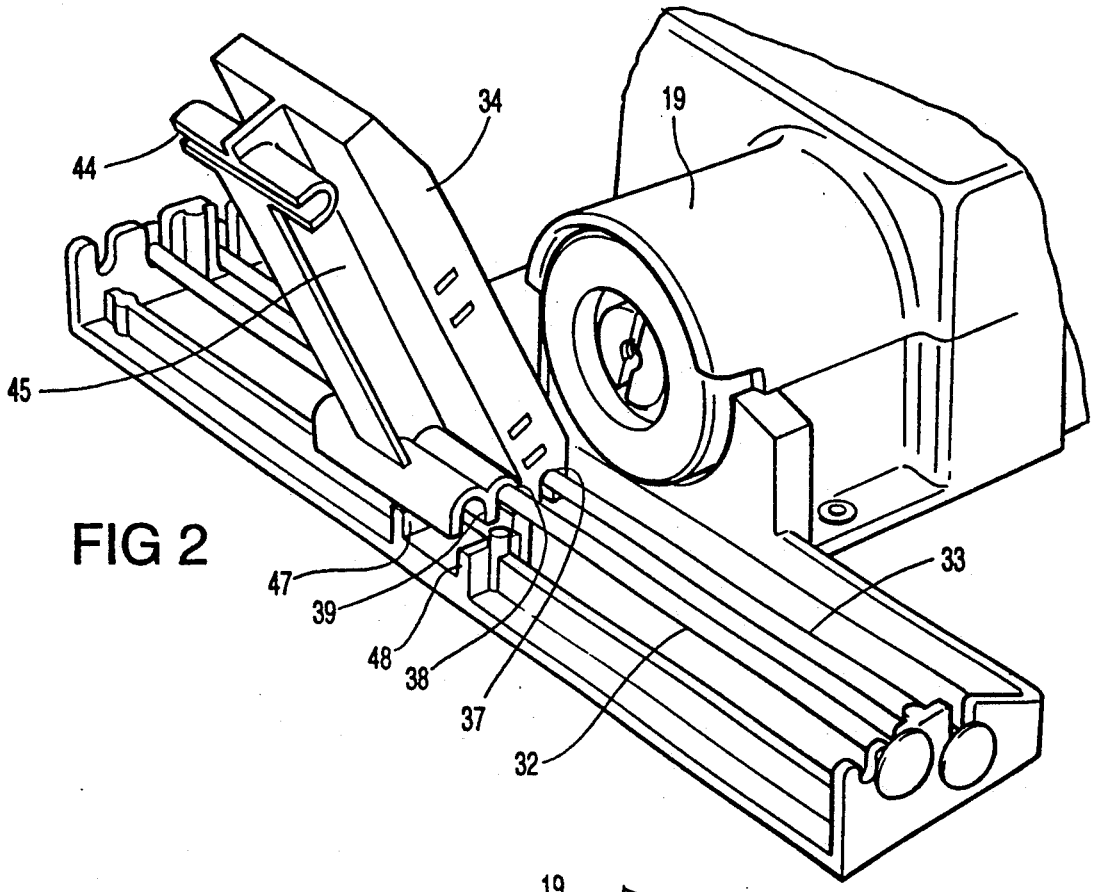
FIG. 2 is an enlarged perspective view of a detail of FIG. 1, showing the components in a first relative orientation.
Figure 3:
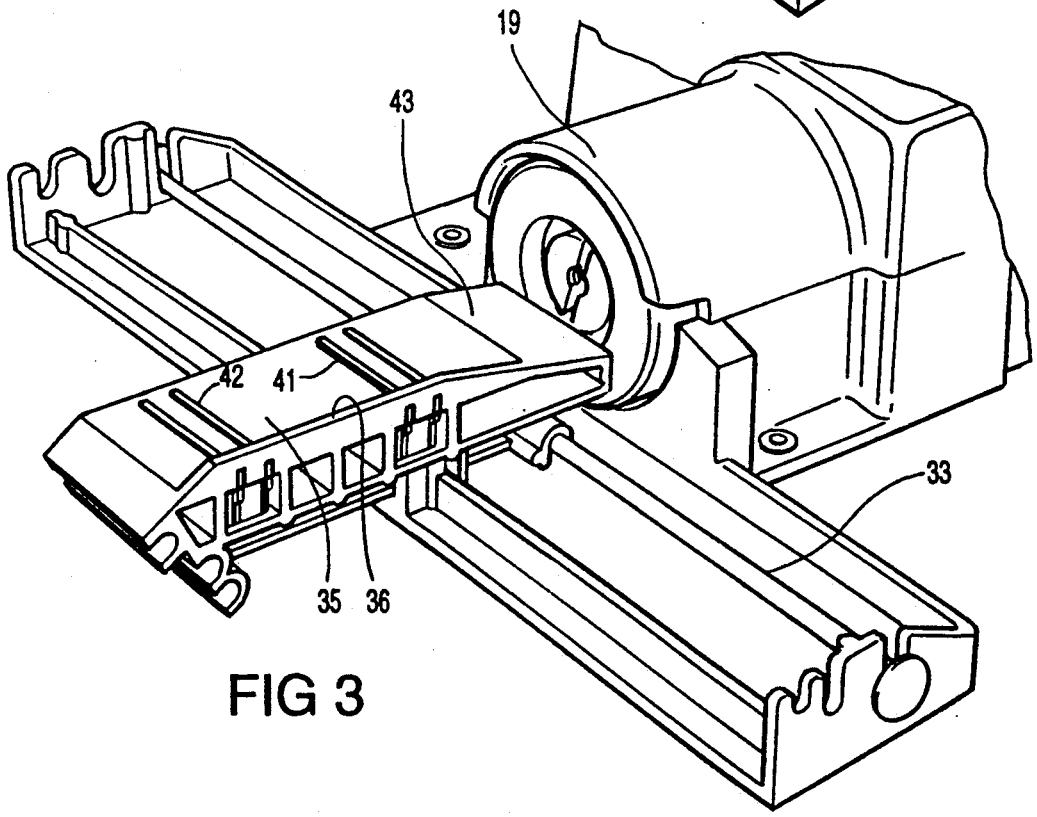
FIG. 3 is a perspective view similar to FIG. 2, showing the components in a second relative orientation.

As can be seen in FIG. 2 the guide rods 32, 33 are adapted to carry a tool guide body 34 having a tool support (or reference) surface 35 with an upstanding side wall or shoulder 36 along one edge. The guide body 34 has a plurality of elongate channels by which it can be fitted to the guide rods 32, 33. These comprise a first elongate channel 37 adapted to be engaged over the guide rod 33, a second elongate channel 38 adapted to be engaged over the guide rod 32 when it is held in the recesses 30*b*, 31*b* closest to the guide rod 33, and a third elongate channel 39 into which the guide rod 32 may be engaged when this latter is housed in the recesses 30*a*, 31*a* in the end walls 28, 29 of the guide structure 27. As will be appreciated from a consideration of FIG. 2, the tool support surface 35 is held at an angle to the flat end face 15 of the grindstone 14 of approximately 25° when the guide rod 32 is in the recesses 30*b*, 31*b* and engaged by the channel 38. When the guide rod 32 is located in the channels 30*a*, 31*a*, however, the guide surface 35 is then held, by virtue of the different locations of the recesses 38, 39, and different depths of the recesses 30*a*, 31*a*, at an angle of approximately 30° to the end face 15. For the purpose of sharpening chisels or plane irons, therefore, which have a chisel edge at 30° and a clearance face at 25° these two angles can be ground with the tool guide body first in one and then in the other of the two positions. With the tool in contact with the support surface 35, it is then advanced along this surface into contact with the annular end face 15 of the grindstone 14, and the guide body 34 then displaced to and fro along the guides 32, 33 until an appropriate edge has been formed.

Figure 5:
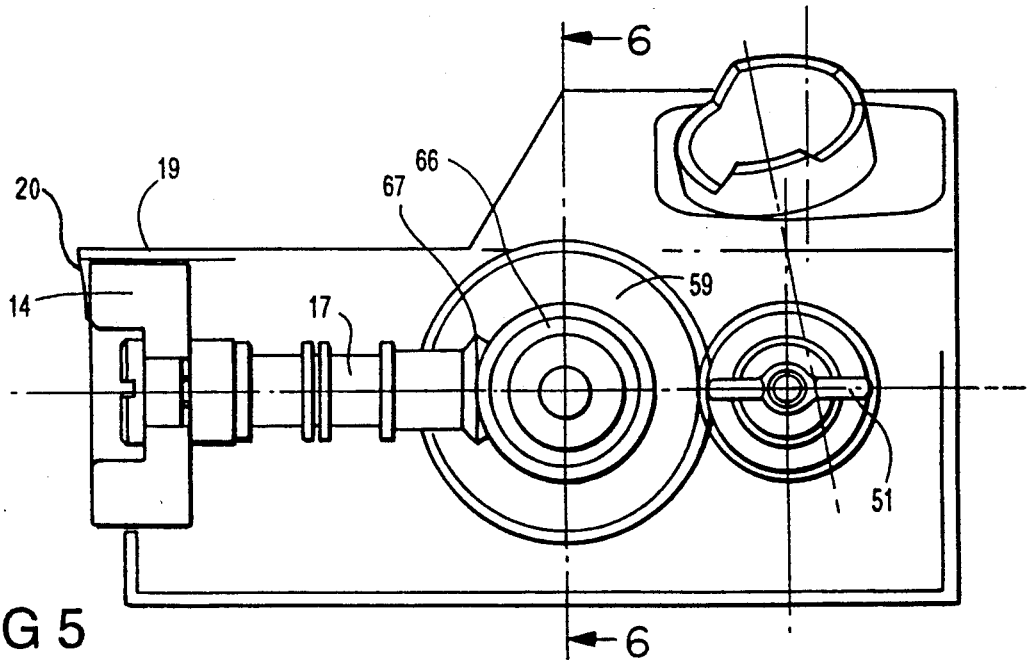
FIG. 5 is a schematic, cut away front view of the embodiment.

The support surface 35 is provided with two sets of parallel magnets 41, 42 for assistance in securely locating a chisel or plane iron against the surface 35; the shoulder 36 offers further support. A second reference surface 43 lying at an angle to the surface 35 may also be brought into operation by turning the guide body 34 through approximately 90° to engage a further recess 44 over the guide rod 33. A central rib 45 of the guide body 34 engages, in this orientation, between two small upstanding walls 47, 48 which between them define a notch 46 to prevent displacement of the guide body 34 along the guide rods 32, 33 so that, in this orientation, the guide body 34 is fixed in position so that the reference surface 43 can be used by bringing up a tool to be sharpened into contact with the end face 15 of the grindstone 14 and drawing it across the reference surface 43 in the same way as a tool is sharpened by drawing it across the reference surface 24 in contact with the cylindrical surface 16 of the grindstone. The angle of the reference surface 43 is somewhat shallower than the angle of the reference surface 24 so that tools such as scissors or shears requiring to be sharpened at a different angle, but using substantially the same operation, can be ground. The end face 20 of tn guard 19, as best seen in FIG. 5, defines a surface inclined towards the end face 15 of the grindstone at a very shallow acute angle to act as a reference surface for grinding blades such as knife blades.

At the opposite end of the casing 12 from the end wall 20 there are located a series of openings 450, 460, 470. The opening 470 is closed by a plug 480 and allows access to the interior of the casing 12 to effect replacement of a second grindstone 49 (FIG. 6) provided for sharpening twist drills which are brought into engagement therewith through the opening 460.

The stone 49 is a cylindrical stone mounted on a shaft 50 to which it is secured by a wing nut 51 screwed on a threaded end 52 of the shaft 50. The shaft 50 is supported in bearings 53, 54 respectively carried on a web 55 and a buttress 56, which latter forms part of a rear wall 57 of the casing 12. Between the buttress 56 and the web 55 the shaft 50 carries a gear wheel 58 which meshes with a further gear wheel 59 carried on an input shaft 60 supported on bearings 61, 62 carried by buttresses 63, 64 respectively forming part of the rear wall 57 and the front wall 18 of the casing 12. The input shaft 60 has an end 65 which projects through the rear wall 57 and is exposed for attachment to a suitable drive device such as a pistol drill or other source of motive power.

The input shaft 60 also carries a bevel gear 66 which meshes with a second bevel gear 67 carried on the shaft 17 on which the cylindrical grindstone 14 is carried. The shaft 17 is borne in bearings 68, 69 on respective webs 70, 71 projecting from the front wall 18 and up from the floor of the casing 12. The relative diameters of the bevel gears 66, 67 and of the gear wheels 58, 59 ensure that the speed of rotation of the grindstones 14 and 49 when the input shaft 60 is driven at a speed attainable by a pistol drill (in the region of 3000 rpm) are different and appropriate to the grinding tasks to be performed thereby.

Figure 6:
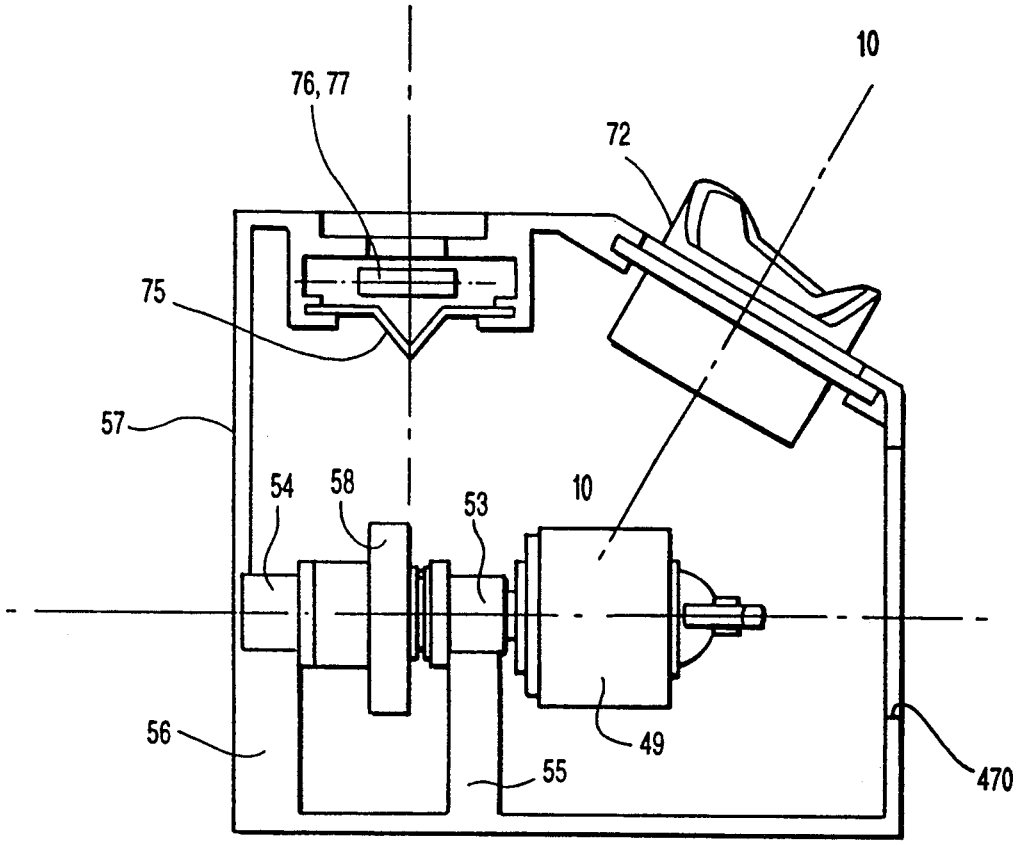
FIG. 6 is a sectional view taken on the line VI—VI of FIG. 5, with several parts removed for the sake of clarity.

Surrounding the opening 460 is a collar 72 having a shaped rim defining a cam profile 73 which acts, in cooperation with a drill holder (not shown) to vary the approach of a drill carried by the drill holder to the stone 49 in dependence on the angular orientation of the drill and the drill holder as this is turned about an axis X—X (FIG. 6). The cam profile and the manner in which the drill grinder part of the tool of the present invention operates is substantially as that described in our earlier U.S. Pat. No. 4,742,648 the disclosure of which is incorporated herein by reference.

The angular orientation of a drill bit in relation to the drill holder can be set by a drill-setting mechanism accessible through the opening 450 in the horizontal upper face portion 13*a* in the casing 12. As can be seen in FIG. 6 this comprises a generally V-shape bottom wall 75 and two relatively slidable longitudinally displaceable members 76, 77 (only one of which is visible in FIG. 6, which are joined together by a linkage mechanism by which both elements 76, 77 are constrained to move towards or away from one another on either side of a central plane of symmetry which defines the location of the axis of the drill in the drill holder when fitted in the setting aperture.

I claim:

1. A tool sharpening device having a rotary grindstone with a planar end grinding face, a tool support having a support face defining a first support surface for supporting a tool to be sharpened against the end grinding face, and linear guide means along which the tool support is displaceable in use of the device, the linear guide means extending transversely of the axis of rotation of the rotary grindstone, and the location of the linear guide means being such as to guide a tool supported on the tool support face to transit across the end grinding face of the rotary grindstone, wherein:

the tool support has guide engagement means for enabling its releasable engagement with the linear guide means the guide engagement means and the linear guide means are selectively engageable so as to locate the tool support in a selected one of two distinct, predetermined orientations relative to the grindstone in each of which the tool support face is inclined at a respective one of two different inclinations to the plane defined by the end grinding face of the grindstone, said tool support face defines said first tool support surface and a second tool support surface at an obtuse angle to each other and intersecting at an adjoining end edge extending transversely of the axis of rotation of the grindstone, and said first tool support surface has a lateral edge extending transverse to said adjoining end edge and an upstanding shoulder extending along the lateral edge and terminating at the adjoining end edge in an end face substantially coplanar with said second tool support surface, whereby a tool supported on the first tool support surface in use of the device can be located securely on the tool support against said shoulder whereas a tool supported on the second tool support surface can project therefrom.

2. The tool sharpening device according to claim 1, characterized in that the linear guide means comprise two rectilinear guide rails and the tool support is releasably engageable on the guide rails selectively in each of said two distinct predetermined positions.

3. The tool sharpening device according to claim 2, characterized in that the tool support is provided with further engagement means for engaging at least one of the linear guide rails in a third orientation with the tool support face substantially orthogonal to the end grinding face of the grindstone.

4. The tool sharpening device according to claim 3, characterized in that there are provided interlock means for engaging the tool support in the third orientation thereof whereby to prevent displacement of the tool support along the linear guide means and to retain the tool support fixedly in a predetermined position with respect to the rotary grindstone.

5. The tool sharpening device according to claim 1, characterized in that the linear guide means are substantially rectilinear rails and at least one of the rails is releasably carried on a guide rail carrier of the device in one of two different positions thereon.

6. The tool sharpening device according to claim 1, characterized in that there is provided a second grindstone turnable about a respective axis of rotation and driven via a drive train from a same input shaft as for the rotary grindstone.

7. The tool sharpening device according to claim 6, characterized in that the second grindstone forms part of a drill sharpener having means for carrying a drill in engagement with a grinding surface of the second grindstone.

8. The tool sharpening device according to claim 1, characterized in that the grindstone is partially circumferentially surrounded by a guard member having a part annular end face which defines an abutment for contact by a blade to be sharpened against the end grinding face of the grindstone, the annular end face defining an abutment plane inclined towards the end grinding face at a shallow acute angle to the plane defined thereby.

9. The tool sharpening device according to claim 8, wherein the grindstone has a circumferential grinding face and the grindstone guard member has an axially extending edge defining part of an opening for access to the circumferential grinding face by one end of an elongate tool to be ground, and the device further includes a fixed tool support post having a support face opposing the axially extending edge for supporting the elongate tool whose end is to be ground against the circumferential grinding face.

* * * * *

UNITED STATES PATENT AND TRADEMARK OFFICE

CERTIFICATE OF CORRECTION

PATENT NO. : 5,311,703
DATED : May 17, 1994
INVENTOR(S) : Thomas Ketteringham

It is certified that error appears in the above-indentified patent and that said Letters Patent is hereby corrected as shown below:

Title page, item [56], under References Cited, line 1, delete "1994" and insert -- 1974 --;

Signed and Sealed this

Eleventh Day of October, 1994

*Attest:*

Bruce Lehman

BRUCE LEHMAN

*Attesting Officer*

*Commissioner of Patents and Trademarks*